US009566485B2

(12) United States Patent
Hasegawa et al.

(10) Patent No.: US 9,566,485 B2
(45) **Date of Patent: *Feb. 14, 2017**

(54) GOLF CLUB SHAFT

(71) Applicant: Dunlop Sports Co. Ltd., Kobe-shi, Hyogo (JP)

(72) Inventors: Hiroshi Hasegawa, Kobe (JP); Kiyofumi Matsunaga, Kobe (JP); Takeshi Shimauchi, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 89 days.

This patent is subject to a terminal disclaimer.

(21) Appl. No.: 14/055,050

(22) Filed: Oct. 16, 2013

(65) Prior Publication Data

US 2014/0106895 A1 Apr. 17, 2014

(30) Foreign Application Priority Data

Oct. 17, 2012 (JP) ..... 2012-229840

(51) Int. Cl.
*A63B 53/10* (2015.01)

(52) U.S. Cl.
CPC ..... *A63B 53/10* (2013.01); *A63B 2209/023* (2013.01); *A63B 2225/02* (2013.01)

(58) Field of Classification Search
CPC ..... A63B 53/10; A63B 2225/02; A63B 2209/023
See application file for complete search history.

(56) References Cited

U.S. PATENT DOCUMENTS

| | | | | |
|---|---|---|---|---|
| 5,813,922 | A * | 9/1998 | Beach et al. | 473/319 |
| 6,273,830 | B1 * | 8/2001 | Takemura et al. | 473/319 |
| 6,306,047 | B1 * | 10/2001 | Kusumoto | 473/319 |
| 6,926,617 | B2 * | 8/2005 | Oyama | 473/319 |
| 6,929,562 | B2 * | 8/2005 | Kumamoto | 473/319 |
| 7,338,386 | B2 * | 3/2008 | Nakajima | 473/319 |
| 7,500,922 | B2 * | 3/2009 | Takeuchi | A63B 53/10 473/319 |
| 2004/0038744 | A1 | 2/2004 | Kumamoto | |
| 2009/0029792 | A1 | 1/2009 | Kumamoto | |
| 2009/0264216 | A1 | 10/2009 | Kato | |
| 2010/0041492 | A1 * | 2/2010 | Rice et al. | 473/289 |

FOREIGN PATENT DOCUMENTS

| | | | |
|---|---|---|---|
| JP | 9-131422 | A | 5/1997 |
| JP | 10-329247 | A | 12/1998 |

(Continued)

*Primary Examiner* — Stephen Blau
(74) *Attorney, Agent, or Firm* — Birch, Stewart, Kolasch & Birch, LLP

(57) ABSTRACT

A shaft 6 includes full length layers provided wholly in a longitudinal direction of the shaft, and a tip end partial layer provided on a tip part of the shaft. The full length layers include a bias layer and a straight layer. The tip end partial layer includes an inner glass fiber reinforced layer. When a full length of the shaft is defined as Ls, and a distance between a tip end of the shaft and a center of gravity G of the shaft is defined as Lg, a ratio (Lg/Ls) is equal to or greater than 0.52 and equal to or less than 0.65. A weight of the shaft is equal to or less than 65 g. Preferably, the inner glass fiber reinforced layer is positioned inside the bias layer.

5 Claims, 7 Drawing Sheets

(56) References Cited

FOREIGN PATENT DOCUMENTS

| | | | |
|---|---|---|---|
| JP | 2001-346925 | A | 12/2001 |
| JP | 2002-35186 | A | 2/2002 |
| JP | 2002-52103 | A | 2/2002 |
| JP | 3317619 | B2 | 8/2002 |
| JP | 4157357 | B2 | 10/2008 |
| JP | 2009-22622 | A | 2/2009 |

* cited by examiner

GOLF CLUB SHAFT

The present application claims priority on Patent Application No. 2012-229840 filed in JAPAN on Oct. 17, 2012, the entire contents of which are hereby incorporated by reference.

BACKGROUND OF THE INVENTION

Field of the Invention

The present invention relates to a golf club shaft.

Description of the Related Art

A so-called carbon shaft has been known as a golf club shaft. A sheet winding process has been known as a method for manufacturing the carbon shaft. In the sheet winding process, a laminated constitution is obtained by winding a prepreg around a mandrel.

The prepreg includes a resin and a fiber. Many types of prepregs exist. A plurality of prepregs having different resin contents have been known. In the present application, the prepreg is also referred to as a prepreg sheet or a sheet.

In the sheet winding process, the type of a sheet, the disposal of the sheet, and the orientation of a fiber can be selected.

A shaft having a reinforced layer disposed on a thin diameter side portion is disclosed in Japanese Patent No. 3317619. The elastic modulus of a carbon fiber contained in the reinforced layer is 5 to 150 GPa.

A shaft including a middle elastic high strength carbon fiber reinforced resin sheet and a low elastic carbon fiber reinforced resin sheet to reinforce the TIP side of the shaft is disclosed in Japanese Patent Application Laid-Open No. 2004-81230(US 2004/0038744). The reinforcing fiber of the low elastic carbon fiber reinforced resin sheet has a tensile elastic modulus of 5 to 10 ton/mm$^2$ and a compressive fracture strain of equal to or greater than 2.0%. The low elastic carbon fiber reinforced resin sheet is disposed on the outer layer side of the middle elastic high strength carbon fiber reinforced resin sheet.

In Japanese Patent No. 4157357, a composite prepreg having a PAN based carbon fiber and a pitch based low elastic fiber is used. In the composite prepreg, the elastic modulus of the PAN based carbon fiber is 200 GPa or greater and 500 GPa or less, and the elastic modulus of the pitch based low elastic fiber is 45 GPa or greater and 160 GPa or less.

Japanese Patent Application Laid-Open No. 10-329247 discloses a tubular body including an inner layer and an outer layer laminated outside the inner layer. The inner layer includes a reinforcing fiber and a resin. The outer layer includes a glass fiber and a resin. The ratio of the thickness of the outer layer to the total thickness of the tubular body is 5 to 35%.

Japanese Patent Application Laid-Open No. 2002-35186 discloses a golf club having a head weight of equal to or greater than 175 g and a club length of equal to or greater than 46 inch. If the total mass of a portion excluding a head is defined as A and the mass of a butt portion formed between a back end of a grip and a point separated by 170 mm from the back end is defined as B in the golf club, the ratio of the mass B to the total mass A is 55% or greater and 70% or less.

SUMMARY OF THE INVENTION

A shaft having a high impact strength is preferable. A shaft having a good feeling is preferable. Such demand for performances has been more and more increased.

It is an object of the present invention to provide a golf club shaft having an excellent strength and a good feeling.

A shaft of the present invention includes: full length layers disposed wholly in a longitudinal direction of the shaft; and a tip end partial layer disposed on a tip part of the shaft. The full length layers include a bias layer and a straight layer.

The tip end partial layer includes an inner glass fiber reinforced layer. When a full length of the shaft is defined as Ls and a distance between a tip end of the shaft and a center of gravity G of the shaft is defined as Lg, a ratio (Lg/Ls) is 0.52 or greater and 0.65 or less. Preferably, a weight of the shaft is equal to or less than 65 g.

Preferably, the inner glass fiber reinforced layer is positioned inside the bias layer.

Preferably, the inner glass fiber reinforced layer is an innermost layer.

Preferably, the shaft further includes a hoop layer. The shaft is equally divided into three in the longitudinal direction to section the shaft into a tip region, a middle region, and a butt region. A weight of the hoop layer in the tip region is defined as Rf1, a weight of the hoop layer in the middle region is defined as Rf2, and a weight of the hoop layer in the butt region is defined as Rf3. Preferably, the weight Rf2 is greater than the weight Rf1. Preferably, the weight Rf2 is greater than the weight Rf3.

A weight of the shaft in the tip region is defined as Ws1, a weight of the shaft in the middle region is defined as Ws2, and a weight of the shaft in the butt region is defined as Ws3. Preferably, (Ws1+Ws3)/Ws2 is equal to or greater than 2.1.

DESCRIPTION OF THE PREFERRED EMBODIMENTS

Hereinafter, the present invention will be described in detail according to the preferred embodiments with appropriate references to the accompanying drawings.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer".

In the present application, an "inside" means an inside in a radial direction of a shaft. In the present application, an "outside" means an outside in the radial direction of the shaft.

Figure 1:
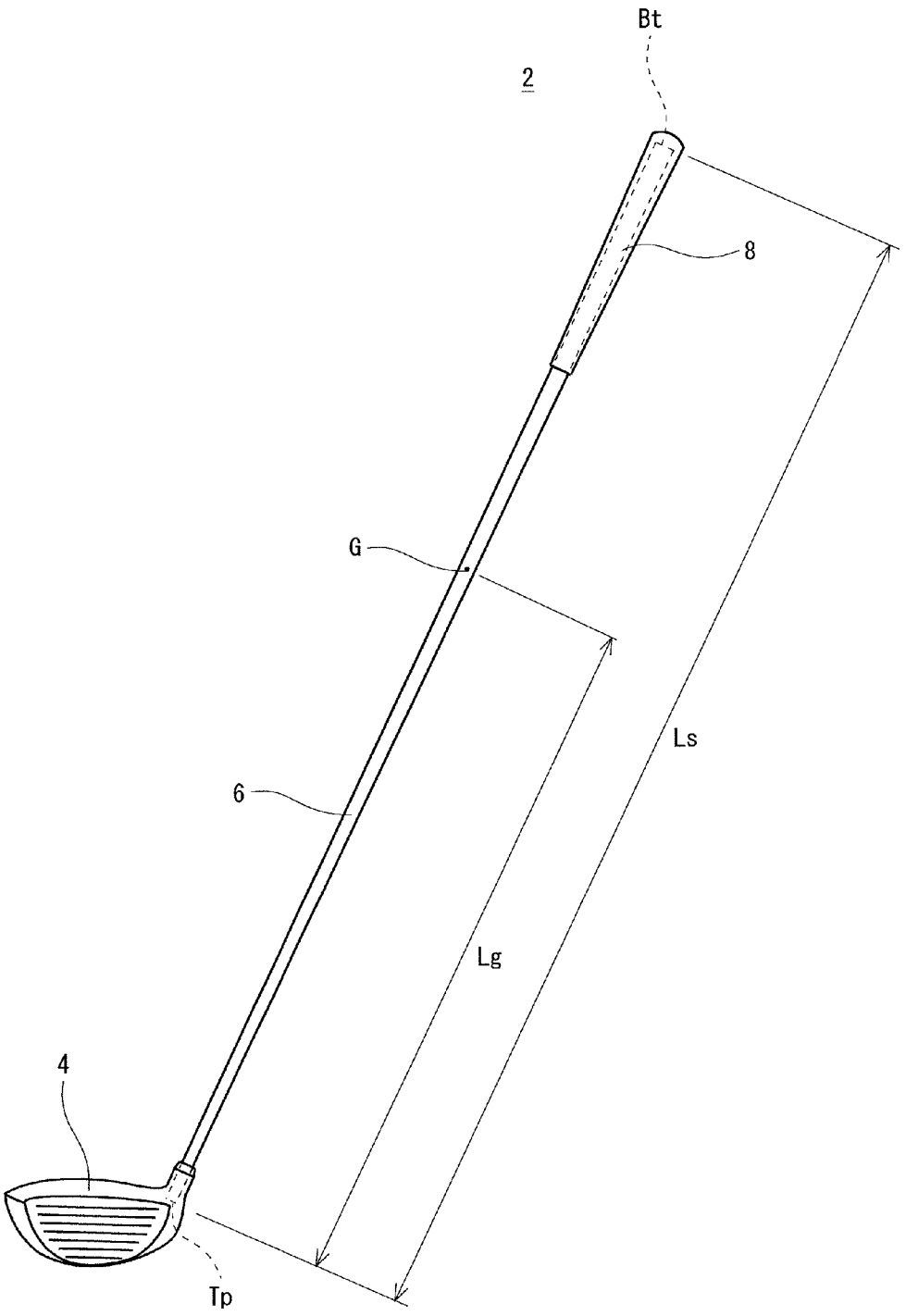
FIG. 1 shows a golf club including a shaft according to a first embodiment of the present invention.

FIG. 1 is an overall view of a golf club 2 including a golf club shaft 6 according to an embodiment of the present invention. The golf club 2 includes a head 4, a shaft 6, and a grip 8. The head 4 is provided on the tip part of the shaft 6. The grip 8 is provided on the back end part of the shaft 6. The head 4 and the grip 8 are not limited. Examples of the head 4 include a wood type golf club head, an iron type golf club head, and a putter head. In the embodiment of FIG. 1, the wood type golf club head is used.

The shaft 6 includes a laminate of fiber reinforced resin layers. The shaft 6 is a tubular body. Although not shown in the drawings, the shaft 6 has a hollow structure. As shown in FIG. 1, the shaft 6 has a tip end Tp and a butt end Bt. The tip end Tp is positioned in the head 4. The butt end Bt is positioned in the grip 8.

The shaft 6 is a so-called carbon shaft. However, as described later, the shaft includes a layer containing a glass fiber as a reinforcing fiber.

The shaft 6 is preferably produced by curing the prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding process. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

The full length of the shaft 6 is represented by a double-pointed arrow Ls in FIG. 1. The full length Ls of the shaft is measured along the axis direction of the shaft 6. The axis direction of the shaft 6 is equal to the longitudinal direction of the shaft 6.

The shaft 6 has a center of gravity G. A distance between the tip end Tp and the center of gravity G of the shaft 6 is represented by a double-pointed arrow Lg in FIG. 1. The distance Lg is measured along the axis direction of the shaft 6.

In the present application, the shaft 6 is sectioned into three regions. In this section, the shaft 6 is equally divided into three in the longitudinal direction.

Figure 2:
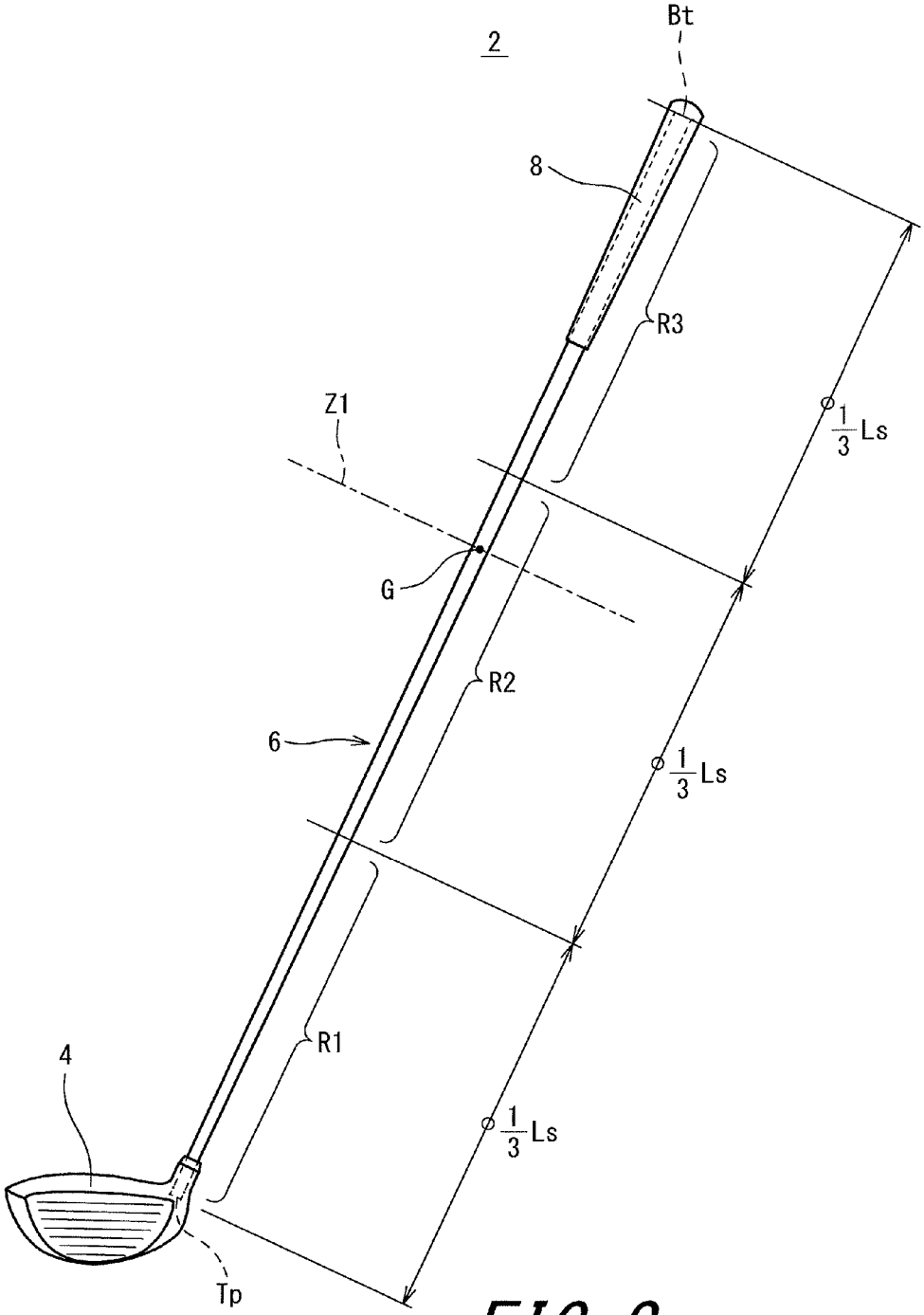
FIG. 2 is the same as FIG. 1, and shows three regions.

FIG. 2 shows the section applied to the shaft 6. The shaft 6 is sectioned into a tip region R1, a middle region R2, and a butt region R3. The length of the tip region R1 in the longitudinal direction is one-third of the full length Ls of the shaft. The length of the middle region R2 in the longitudinal direction is one-third of the full length Ls of the shaft. The length of the butt region R3 in the longitudinal direction is one-third of the full length Ls of the shaft.

Figure 3:
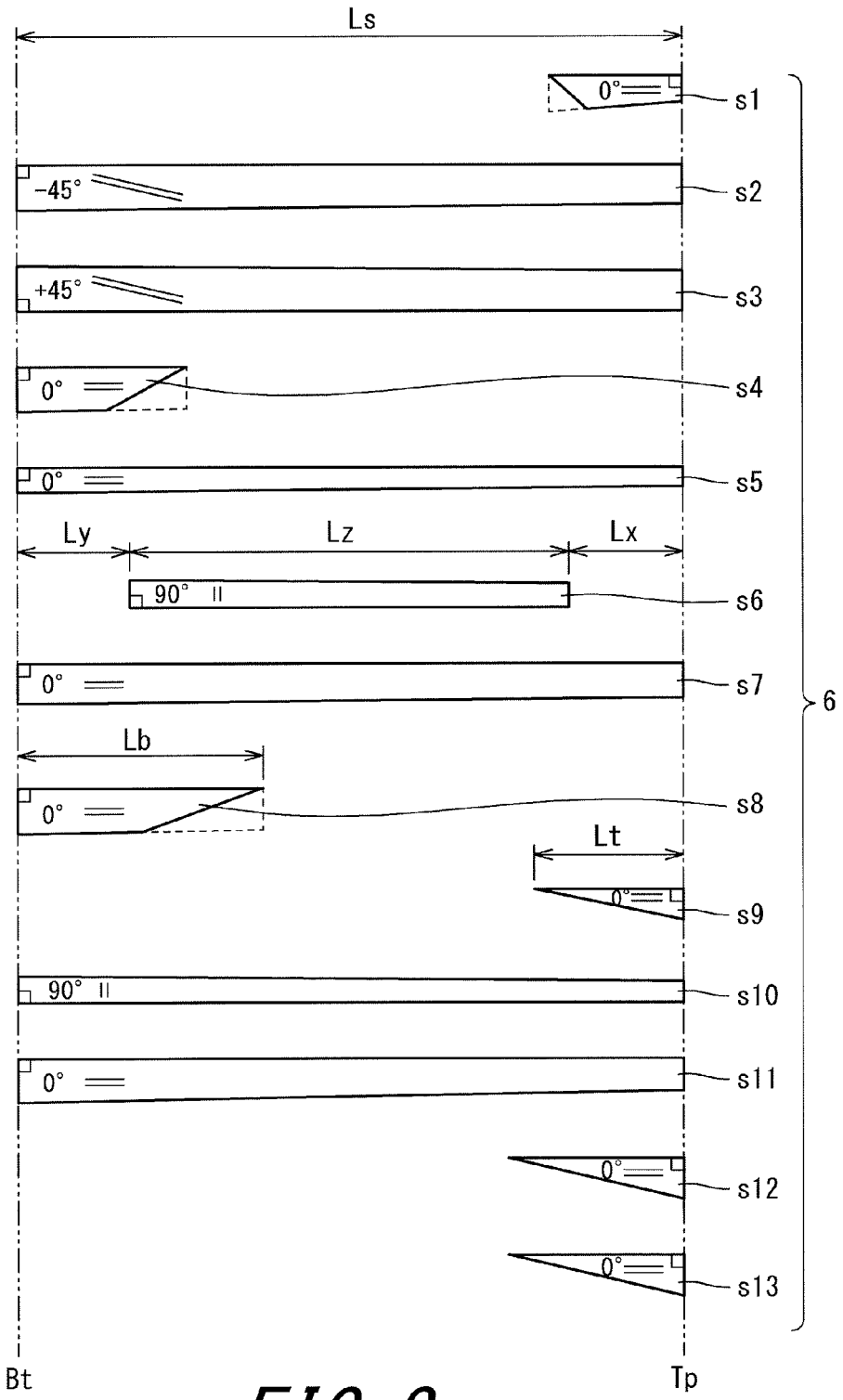
FIG. 3 is a developed view of the shaft of FIG. 1.

FIG. 3 is a developed view (sheet constitution view) of the prepreg sheets constituting the shaft 6. The shaft 6 includes a plurality of sheets. In the embodiment of FIG. 3, the shaft 6 includes thirteen sheets of a first sheet s1 to a 13th sheet s13. In the present application, the developed view shown in FIG. 3 or the like shows the sheets constituting the shaft in order from the radial inner side of the shaft. The sheets are wound in order from the sheet positioned on the uppermost side in the developed view. However, as described later, the sheet to be stacked is wound in a state of a united sheet.

In the developed view of the present application, the horizontal direction of the figure coincides with the axial direction of the shaft. In the developed view of the present application, the right side of the figure is the tip end Tp side of the shaft. In the developed view of the present application, the left side of the figure is the butt end Bt side of the shaft.

The developed view of the present application shows not only the winding order of each of the sheets but also the arrangement of each of the sheets in the axial direction of the shaft. For example, in FIG. 3, one end of the sheet s1 is positioned on the tip end Tp.

The shaft 6 has a straight layer and a bias layer. In the developed view of the present application, the orientation angle of the fiber is described. A sheet described as "0 degree" constitutes the straight layer. The sheet for the straight layer is also referred to as a straight sheet in the present application.

The straight layer is a layer in which the orientation of the fiber is substantially 0 degree to the longitudinal direction of the shaft (axial direction of the shaft). The incompletely parallel orientation of the fiber to the axis direction of the shaft is usually caused by an error or the like in winding. In the straight layer, an absolute angle θa of the fiber to the axis line of the shaft is equal to or less than 10 degrees. The absolute angle θa is an absolute value of an angle between the axis line of the shaft and the direction of the fiber. That is, the absolute angle θa of equal to or less than 10 degrees means that an angle Af between the direction of the fiber and the axis direction of the shaft is −10 degrees or greater and +10 degrees or less.

In the embodiment of FIG. 3, the straight sheets are the sheet s1, the sheet s4, the sheet s5, the sheet s7, the sheet s8, the sheet s9, the sheet s11, the sheet s12, and the sheet s13. The straight layer is highly correlated with flexural rigidity and a flexural strength.

The bias layer is mainly provided in order to enhance the torsional rigidity and torsional strength of the shaft. Preferably, the bias layer includes a pair of sheets in which the orientations of the fibers are inclined in opposite directions to each other. Preferably, the bias layer includes a layer having the angle Af of −60 degrees or greater and −30 degrees or less and a layer having the angle Af of 30 degrees or greater and 60 degrees or less. That is, preferably, the absolute angle θa in the bias layer is 30 degrees or greater and 60 degrees or less.

In the shaft 6, the sheets constituting the bias layer are the sheet s2 and the sheet s3. In FIG. 3, the angle Af is described in each sheet. The plus (+) and minus (−) in the angle Af show that the fibers of bias sheets stacked to each other are inclined in opposite directions to each other. In the present application, the sheet for the bias layer is merely referred to as a bias sheet.

The sheet s3 is turned over, and stacked on the sheet s2. By the turnover, the angle Af of the sheet s3 is an opposite direction to the angle Af of the sheet s2. In light of this point, in FIG. 3, "−45 degrees" is described in the sheet s2, and "+45 degrees" is described in the sheet s3.

In the embodiment of FIG. 3, the angle of the sheet s2 is −45 degrees and the angle of the sheet s3 is +45 degrees. However, conversely, it should be appreciated that the angle of the sheet s2 may be +45 degrees and the angle of the sheet s3 may be −45 degrees.

A hoop layer is a layer in which the fiber is oriented along the circumferential direction of the shaft. Preferably, the absolute angle θa in the hoop layer is substantially 90 degrees to the axis line of the shaft. However, the orientation of the fiber to the axis direction of the shaft may not be completely set to 90 degrees due to an error or the like in winding. Normally, in the hoop layer, the absolute angle θa is equal to or greater 80 degrees. The upper limit value of the absolute angle θa is 90 degrees.

The hoop layer contributes to the increase in the crushing rigidity and crushing strength of the shaft. The crushing rigidity is rigidity to a force crushing the shaft toward the inside of the radial direction thereof. The crushing strength is a strength to a force crushing the shaft toward the inside of the radial direction thereof. The crushing strength can also be involved with the flexural strength. Crushing deformation can be generated with flexural deformation. In a particularly thin lightweight shaft, this interlocking property is large. The increase in the crushing strength also can cause the increase in the flexural strength.

In the embodiment of FIG. 3, the prepreg sheets for the hoop layer are the sheet s6 and the sheet s10. In the present application, the prepreg sheet for the hoop layer is also referred to as a hoop sheet.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

The film side surface is shown in the developed view of the present application.

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semicured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is first peeled. Next, the winding start edge part is applied on the wound object, and the mold release paper is then peeled. Thus, the resin film is first peeled, and after the winding start edge part is applied on the wound object, the mold release paper is peeled. The procedure suppresses the wrinkles and winding fault of the sheet. This is because the sheet on which the mold release paper is applied is supported by the mold release paper, and causes less wrinkle. The mold release paper has flexural rigidity higher than that of the resin film.

A united sheet is used in the embodiment of FIG. 3. The united sheet is formed by stacking two sheets.

The three united sheets are formed in the embodiment of FIG. 3. A bias united sheet obtained by stacking the sheet s2 and the sheet s3 is formed. The two sheets s2 and s3 are used as the bias layer. The orientation angles of the fibers of the sheets s2 and s3 are opposite to each other. The directivity of a torsional direction can be eliminated by the set of the sheets s2 and s3.

In the embodiment of FIG. 3, a hoop straight united sheet obtained by stacking the sheet s6 and the sheet s7 is formed. The sheet s6 is turned over, and stacked on the sheet s7. A hoop straight united sheet obtained by stacking the sheet s10 and the sheet s11 is formed. The sheet s10 is turned over, and stacked on the sheet s11.

As described above, in the present application, the sheet and the layer are classified by the orientation angle of the fiber. In addition, in the present application, the sheet and the layer are classified by the length and position of the shaft in the longitudinal direction.

In the present application, a layer disposed wholly in the longitudinal direction of the shaft is referred to as a full length layer. In the present application, a sheet disposed wholly in the longitudinal direction of the shaft is referred to as a full length sheet. The wound full length sheet forms a full length layer.

Meanwhile, in the present application, a layer disposed partially in the longitudinal direction of the shaft is referred to as a partial layer. In the present application, a sheet disposed partially in the longitudinal direction of the shaft is referred to as a partial sheet. The wound partial sheet forms the partial layer.

In the present application, a partial layer having one end positioned on the tip end Tp is referred to as a tip end partial layer. The wound tip partial sheet forms the tip end partial layer.

In the present application, a partial layer having one end positioned on the butt end Bt is referred to as a butt end partial layer. The wound back end partial sheet forms the butt end partial layer.

In the present application, a partial layer having one end which is not positioned on the tip end Tp and the other end which is not positioned on the butt end Bt is referred to as a middle partial layer. The wound middle partial sheet forms the middle partial layer.

In the present application, the terms described above are combined. For example, the combinations are as follows. The full length layer which is the bias layer is referred to as a full length bias layer. The full length layer which is the straight layer is referred to as a full length straight layer. The full length layer which is the hoop layer is referred to as a full length hoop layer. The partial layer which is the bias layer is referred to as a partial bias layer. The partial layer which is the straight layer is referred to as a partial straight layer. The partial layer which is the hoop layer is referred to as a partial hoop layer.

In the embodiment of FIG. 3, the sheet s6 is the middle partial sheet. The sheet s6 is a hoop sheet. Therefore, the sheet s6 is also referred to as a middle partial hoop sheet.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 3 is cut out by the process.

The cutting may be performed by a cutting machine, or may be manually performed. In the manual case, for example, a cutter knife is used.

(2) Stacking Process

A plurality of sheets are stacked in the stacking process to produce the united sheets.

In the stacking process, heating or a press may be used. More preferably, the heating and the press are used in combination. In a winding process to be described later, the deviation of the sheet may occur during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to produce the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of the tackiness of the sheet, the heating time in the stacking process is preferably equal to or less than 300 seconds. In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value.

In respect of the thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

The sheets to be stacked are wound in a state of the united sheet.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wound around the outer peripheral surface of the winding body in the tape wrapping process. The tape is also referred to as a wrapping tape. The wrapping tape is wound while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both End Parts

The both end parts of the cured laminate are cut in the process. The cutting flattens the end face of the tip end Tp and the end face of the butt end Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate.

(9) Coating Process

The cured laminate after the polishing process is subjected to coating.

In the present application, the same reference numeral is used in the layer and the sheet. For example, a layer formed by the sheet s1 is the layer s1. The shaft 6 includes the first layer s1 to the 13th layer s13. The layer number of each layer is not limited to 1. The number of windings (plus number) of each layer may be less than 1, and may be greater than 1. For example, a layer in which the number of windings is 2 is wound twice in the circumferential direction. The layer number of the layer is 2.

A distance between the back end of the tip end partial layer and the tip end Tp of the shaft 6 is represented by a double-pointed arrow Lt in FIG. 3. In respect of a shaft mass dispersion effect to be described later, the distance Lt is preferably equal to or less than 500 mm, more preferably equal to or less than 450 mm, and still more preferably equal to or less than 400 mm.

A distance between the tip of the butt end partial layer and the butt end Bt of the shaft 6 is represented by a double-pointed arrow Lb in FIG. 3. In respect of a shaft mass dispersion effect to be described later, the distance Lb is preferably equal to or less than 600 mm, more preferably equal to or less than 550 mm, and still more preferably equal to or less than 500 mm.

A pitch based carbon fiber reinforced prepreg may be used as the prepreg of the back end partial sheet. The pitch based carbon fiber can have a structure where atoms are temporarily deviated in the molecular structure thereof when a force is applied to the pitch based carbon fiber. The vibration absorbability can be caused by the structure. The back end partial sheet containing the pitch based carbon fiber is also referred to as a pitch-containing back end partial sheet in the present application. In the embodiment of FIG. 3, the pitch-containing back end partial sheet is the sheet s4. The back end portion of the shaft 6 is a portion to which a grip is attached. Vibration in the back end portion of the shaft 6 is apt to be transmitted to a golfer. The vibration transmitted to the golfer can be effectively suppressed by providing the pitch-containing back end partial sheet.

A distance between the tip of the middle partial hoop layer and the tip end Tp of the shaft 6 is represented by a double-pointed arrow Lx in FIG. 3. In respect of a middle hoop effect to be described later, the distance Lx is preferably equal to or greater than 100 mm, more preferably equal to or greater than 150 mm, and still more preferably equal to or greater than 200 mm. In respect of the middle hoop effect, the distance Lx is preferably equal to or less than 500 mm, and more preferably equal to or less than 400 mm.

A distance between the back end of the middle partial hoop layer and the butt end Bt of the shaft 6 is represented by a double-pointed arrow Ly in FIG. 3. In respect of the middle hoop effect to be described later, the distance Ly is preferably equal to or greater than 100 mm, more preferably equal to or greater than 150 mm, and still more preferably equal to or greater than 200 mm. In respect of the middle hoop effect, the distance Ly is preferably equal to or less than 500 mm, and more preferably equal to or less than 400 mm.

A length of the middle partial hoop layer in the longitudinal direction is represented by a double-pointed arrow Lz in FIG. 3. In respect of the middle hoop effect to be described later, the ratio of the distance Lz to the full length Ls of the shaft is preferably considered. As a lower limit, a ratio (Lz/Ls) is preferably equal to or greater than 0.35, more preferably equal to or greater than 0.4, and still more preferably equal to or greater than 0.45. As a upper limit, the ratio (Lz/Ls) is preferably equal to or less than 0.8, more preferably equal to or less than 0.75, and still more preferably equal to or less than 0.7.

In the embodiment of FIG. 3, a glass fiber reinforced prepreg is used. In the glass fiber reinforced prepreg, a reinforcing fiber is a glass fiber. In the glass fiber reinforced prepreg of the embodiment, the fiber is oriented substantially in one direction. That is, the glass fiber reinforced prepreg is a UD prepreg. A glass fiber reinforced prepreg other than the UD prepreg may be used. For example, glass fibers contained in the prepreg sheet may be woven.

In the embodiment, a prepreg other than the glass fiber reinforced prepreg is a carbon fiber reinforced prepreg. Examples of the carbon fiber include a PAN based carbon fiber and a pitch based carbon fiber.

In the embodiment, the sheet s1 is the glass fiber reinforced prepreg. The glass fiber reinforced prepreg is used for a straight tip end partial layer. The innermost straight tip end partial layer s1 is a glass fiber reinforced layer. The tip end partial layer s1 is disposed inside the bias layers s2 and s3. The sheet s1 is not the outermost layer. The glass fiber reinforced layer which is not the outermost layer is also referred to as an inner glass fiber reinforced layer in the present application.

In the embodiment of FIG. 3, a straight tip end partial layer s9 is provided outside the tip end partial layer s1. A carbon fiber reinforced prepreg is used for the tip end partial layer s9. The tip end partial layer s9 is disposed outside the bias layers s2 and s3. A full length hoop layer s10 and a full length straight layer s11 are provided outside the tip end partial layer s9.

In the embodiment of FIG. 3, straight tip end partial layers s12 and s13 are provided outside the straight tip end partial layer s9. The straight tip end partial layer s13 is the outermost layer.

The shape of the mandrel corresponds to the thickness of the tip end partial layer s1 positioned inside the bias layers s2 and s3. At the position where the tip end partial layer s1 is wound, the mandrel is made thin. The mandrel is designed so that the outer shape of the mandrel with the tip end partial layer s1 in a state where the tip end partial layer s1 is wound is a simple taper shape. Therefore, the generation of wrinkles caused by the tip end partial layer s1 is suppressed.

Thus, in the shaft 6, the tip end partial layer contains an inner glass fiber reinforced layer s1.

The inner layer of the shaft is close to the neutral axis of the section of the shaft (the axis line of the shaft). Therefore, a tensile stress and a compressive stress which are generated when the ball is hit in the inner layer of the shaft are smaller than those in the outer layer of the shaft. Meanwhile, it became clear that an impact-absorbing energy is improved by disposing the glass fiber reinforced layer from test results to be described later. From the finding, the inside disposal of the glass fiber reinforced layer s1 is effective in improvement in the impact-absorbing energy (effect A). In the shaft 6, the inner glass fiber reinforced layer s1 is positioned inside the bias layers s2 and s3. Therefore, the effect A can be improved.

In the shaft 6, the inner glass fiber reinforced layer s1 is the innermost layer. Therefore, the distance between the layer s1 and the neutral axis is the shortest, which can further improve the effect A.

The elastic modulus of the glass fiber is about 7 to 8 ton/mm$^2$, and comparatively low. The excessive reduction of the rigidity can be suppressed by disposing the low elastic glass fiber in the inner layer. That is, in the embodiment, an impact strength is improved by utilizing the inner layer in which the contribution degree of the flexural rigidity is low. Therefore, the impact strength is improved while the moderate flexural rigidity is secured (effect B).

In respect of the impact-absorbing energy, the glass fiber reinforced layer may be additionally provided outside the bias layers s2 and s3.

The smaller weight of the shaft makes it difficult to achieve both the sufficient rigidity and the strength. For this reason, the embodiment is particularly effective for a lightweight shaft. In this respect, the weight Mt of the shaft is preferably equal to or less than 65 g. In respect of the strength of the shaft, the weight Mt of the shaft is preferably equal to or greater than 35 g, and more preferably equal to or greater than 38 g.

An epoxy resin, a thermosetting resin other than the epoxy resin, and a thermoplastic resin or the like may be used as the matrix resin of the prepreg sheet. In respect of the strength of the shaft, the matrix resin is preferably the epoxy resin.

[Center of Gravity G of Shaft]

As shown in FIG. 1, the center of gravity G of the shaft is positioned in the shaft 6. The center of gravity G is positioned on the axis line of the shaft. The center of gravity G is the center of gravity of the single shaft 6. In the embodiment, the center of gravity G is positioned in the middle region R2 (see FIG. 2).

[Full Length Ls of Shaft]

The present invention is effective in a comparatively long golf club. In this respect, the full length Ls of the shaft is preferably equal to or greater than 41 inch, more preferably equal to or greater than 42 inch, still more preferably equal to or greater than 42.5 inch, and yet still more preferably equal to or greater than 43 inch. In respects of easiness of swing and the golf rules, the full length Ls of shaft is preferably equal to or less than 47 inch.

Rf2 is made greater than Rf1 and Rf3, and thereby an effect to be described later can be obtained. As the shaft is longer, the effect is more effective. In this respect, the full length Ls of the shaft is preferably equal to or greater than 43.5 inch, more preferably equal to or greater than 44 inch, still more preferably equal to or greater than 44.5 inch, and yet still more preferably equal to or greater than 45 inch.

[Distance Lg Between Tip End Tp and Center of Gravity G of Shaft]

When the distance Lg is long, the center of gravity G of the shaft is close to the butt end Bt. The position of the center of gravity can cause a light swing balance and improve the easiness of swing. The position of the center of gravity can contribute to improvement in a head speed.

In respects of the easiness of swing and the head speed, the distance Lg is preferably equal to or greater than 615 mm, more preferably equal to or greater than 620 mm, still more preferably equal to or greater than 625 mm, and yet still more preferably equal to or greater than 630 mm.

When the center of gravity G of the shaft is too close to the butt end Bt, a centrifugal force acting on the center of gravity G of the shaft is apt to be reduced. That is, when the ratio of the center of gravity of the shaft is large, the centrifugal force acting on the center of gravity G of the shaft is apt to be reduced. In this case, the flexure of the shaft may be hardly felt. The shaft of which the flexure is hardly felt is apt to cause a rigid feeling. In respect of suppressing the rigid feeling, the distance Lg is preferably equal to or less than 660 mm, more preferably equal to or less than 655 mm, and still more preferably equal to or less than 650 mm.

[Lg/Ls] (Ratio of Center of Gravity of Shaft)

In respects of the easiness of swing and the head speed, a ratio (Lg/Ls) is preferably equal to or greater than 0.52, more preferably equal to or greater than 0.53, and still more preferably equal to or greater than 0.54. When the ratio (Lg/Ls) is excessively large, the shaft strength of the tip part may be reduced. In respect of the shaft strength, the ratio (Lg/Ls) is preferably equal to or less than 0.65, and more preferably equal to or less than 0.64.

Examples of means for adjusting the ratio of the center of gravity of the shaft include the following items (a1) to (a9):

(a1) increase or decrease of the number of windings of the butt end partial layer;

(a2) increase or decrease of a thickness of the butt end partial layer;

(a3) increase or decrease of an axial length of the butt anti partial layer;

(a4) increase or decrease of a resin content rate of the butt end partial layer;

(a5) increase or decrease of the number of windings of the tip end partial layer;

(a6) increase or decrease of a thickness of the tip end partial layer;

(a7) increase or decrease of an axial length of the tip end partial layer;

(a8) increase or decrease of a resin content rate of the tip end partial layer; and (a9) increase or decrease of a taper ratio of the shaft.

In the present application, the weight of the hoop layer in the tip region R1 is defined as Rf1; the weight of the hoop layer in the middle region R2 is defined as Rf2; and the weight of the hoop layer in the butt region R3 is defined as Rf3.

In the embodiment, the weight Rf2 is greater than the weight Rf1. The weight Rf2 is greater than the weight Rf3. These relationships are caused by the middle partial hoop sheet s6.

From the relationships of Rf2>Rf1 and Rf2>Rf3, the middle region R2 tends to be the most easily bent during swinging. Crushing deformation can be generated with the bending. Rf2 is made greater than Rf1 and Rf3, and thereby the crushing deformation of the middle region R2 is suppressed. A feeling is considered to be improved by suppressing the crushing deformation. A feeling referred to as a "firm feeling" is considered to be improved by suppressing the crushing deformation. The "firm feeling" is an evaluation item to which a hard hitter having a comparatively fast head speed particularly attaches importance. In light of the hard hitter, the weight of the shaft is preferably equal to or greater than 58 g.

As described above, the middle region R2 tends to be the most easily bent during swinging. Meanwhile, the hoop layer hardly influences the flexural rigidity. Therefore, Rf2 is made greater than Rf1 and Rf3, and thereby the middle region R2 is likely to be largely bent, which can improve the head speed. A feeling referred to as a "bending feeling" is considered to be improved by the bending in the middle region R2. The "bending feeling" is an evaluation item to which an average golfer having a comparatively slow head speed particularly attaches importance. In light of the average golfer, the weight of the shaft is preferably less than 58 g.

In respect of obtaining the effect, Rf2/Rf1 is preferably equal to or greater than 1.1, and more preferably equal to or greater than 1.2. From design restriction, Rf2/Rf1 is preferably equal to or less than 3.

In respect of obtaining the effect, Rf2/Rf3 is preferably equal to or greater than 1.1, and more preferably equal to or greater than 1.2. From design restriction, Rf2/Rf3 is preferably equal to or less than 2.5.

In the embodiment, (Ws1+Ws3)/Ws2 is set to be equal to or greater than 2.1. The ratio produces the shaft mass dispersion effect. The moment of inertia MIs of the shaft 6 around the center of gravity of the shaft is increased by dispersing the mass of the shaft in the tip part and the back end part. FIG. 2 shows an axis Z1 passing through the center of gravity G of the shaft and being perpendicular to the axis line of the shaft. The moment of inertia MIs is the moment of inertia of the shaft 6 around the axis Z1.

The behavior of the shaft during swinging can be stabilized by increasing the moment of inertia MIs. For this reason, the variation in the behavior of the shaft is decreased, which is likely to stabilize hit ball directivity and a trajectory. (Ws1+Ws3)/Ws2 is increased to increase the moment of inertia MIs, which can decrease the variation in a hit ball. This is the shaft mass dispersion effect.

In respect of the shaft mass dispersion effect, (Ws1+Ws3)/Ws2 is preferably equal to or greater than 2.1, more preferably equal to or greater than 2.2, and still more preferably equal to or greater than 2.3. When (Ws1+Ws3)/Ws2 is excessive, the strength in the middle region R2 may be reduced. In this respect, (Ws1+Ws3)/Ws2 is preferably equal to or less than 3.0, more preferably equal to or less than 2.9, and still more preferably equal to or less than 2.8.

The middle region R2 tends to be easily bent by increasing (Ws1+Ws3)/Ws2. For this reason, the bending feeling is considered to be likely to be improved.

In respect of increasing the ratio of the center of gravity (Lg/Ls) of the shaft, Ws3/Ws1 is preferably equal to or greater than 2.1, more preferably equal to or greater than 2.2, and still more preferably equal to or greater than 2.3. When the weight Ws3 is excessive, the shaft rigidity of a grip part may be excessive, which deteriorates the feeling. In this respect, Ws3/Ws1 is preferably equal to or less than 3.0, more preferably equal to or less than 2.9, and still more preferably equal to or less than 2.8.

In respect of increasing the ratio of the center of gravity (Lg/Ls) of the shaft, Ws3/Ws2 is preferably equal to or greater than 1.10, more preferably equal to or greater than 1.15, and still more preferably equal to or greater than 1.20. When the weight Ws3 is excessive, the shaft rigidity of the grip part may be excessive, which deteriorates the feeling. In this respect, Ws3/Ws2 is preferably equal to or less than 2.00, more preferably equal to or less than 1.95, and still more preferably equal to or less than 1.90.

When the weight of the middle region R2 is reduced, the crushing deformation in the middle region R2 is apt to be particularly produced. However, Rf2 is made greater than Rf1 and Rf3, and thereby the crushing deformation of the middle region R2 is suppressed. When (Ws1+Ws3)/Ws2 is large, the middle hoop effect can be further exhibited.

In respect of enhancing the middle hoop effect, a hoop layer ratio F2 in the middle region R2 is preferably equal to or greater than 0.02, more preferably equal to or greater than 0.03, and still more preferably equal to or greater than 0.04. The ratio F2 is Rf2/Ws2.

Examples of means for adjusting (Ws1+Ws3)/Ws2 include the following items (b1) to (b9):

(b1) increase or decrease of the number of windings of the butt end partial layer;

(b2) increase or decrease of a thickness of the butt end partial layer;

(b3) increase or decrease of an axial length of the butt end partial layer;

(b4) increase or decrease of a resin content rate of the butt end partial layer;

(b5) increase or decrease of the number of windings of the tip end partial layer;

(b6) increase or decrease of a thickness of the tip end partial layer;

(b7) increase or decrease of an axial length of the tip end partial layer;

(b8) increase or decrease of a resin content rate of the tip end partial layer; and (b9) increase or decrease of a taper ratio of the shaft.

Thus, in the embodiment, the middle hoop effect and the shaft mass dispersion effect can be obtained. Therefore, the feeling is good and the variation in the hit ball can be suppressed.

EXAMPLES

Hereinafter, the effects of the present invention will be clarified by examples. However, the present invention should not be interpreted in a limited way based on the description of examples.

Example 1a

A shaft having the same laminated constitution as that of the shaft 6 was produced. That is, a shaft having the sheet constitution shown in FIG. 3 was produced. A manufacturing method is the same as that of the shaft 6. Trade names of prepregs used for sheets are as follows. A sheet s1 is a glass fiber reinforced prepreg. Sheets other than the sheet s1 are carbon fiber reinforced prepregs. A sheet s4 is a pitch-containing back end partial sheet.

- sheet s1: GE352H-160S (manufactured by Mitsubishi Rayon Co., Ltd.)
- sheet s2: HRX350C-075S (manufactured by Mitsubishi Rayon Co., Ltd.)
- sheet s3: HRX350C-075S (manufactured by Mitsubishi Rayon Co., Ltd.)
- sheet s4: E1026A-14N (manufactured by Nippon Graphite Fiber Corporation)
- sheet s5: MR350C-150S (manufactured by Mitsubishi Rayon Co., Ltd.)
- sheet s6: 805S-3 (manufactured by Toray Industries, Inc.)
- sheet s7: MR350C-125S (manufactured by Mitsubishi Rayon Co., Ltd.)
- sheet s8: MR350C-125S (manufactured by Mitsubishi Rayon Co., Ltd.)
- sheet s9: TR350C-100S (manufactured by Mitsubishi Rayon Co., Ltd.)
- sheet s10: 805S-3 (manufactured by Toray Industries, Inc.)
- sheet s11: TR350C-125S (manufactured by Mitsubishi Rayon Co., Ltd.)
- sheet s12: TR350C-100S (manufactured by Mitsubishi Rayon Co., Ltd.)
- sheet s13: TR350C-100S (manufactured by Mitsubishi Rayon Co., Ltd.)

The trade name "GE352H-160S" is a glass fiber reinforced prepreg. A glass fiber is E glass, and the tensile elastic modulus of the glass fiber is 75 GPa (7.65 ton/mm$^2$).

The trade name "E1026A-14N" is a pitch based carbon fiber reinforced prepreg. The part number of the pitch based carbon fiber is "XN-10", and the tensile elastic modulus thereof is 110 GPa (11.2 ton/mm$^2$).

The full length Ls of the shaft of example 1a was 1168 mm. A titanium head (driver head) having a head volume of 460 cc and a grip were attached to the shaft to obtain a golf club of the example 1a.

Examples 2a and 3a and Comparative Example 1a

Examples 2a and 3a and comparative example 1a having specifications shown in Table 2 to be described later were obtained by appropriately using the adjusting means. For the example 3a, a sheet s6 was substituted with a full length hoop layer, and increase in a weight due to the substitution was compensated by reducing a resin content rate of the other prepreg. Shafts and golf clubs of the examples 2a and 3a and the comparative example 1a were obtained in the same manner as in the example 1a except for above.

Comparative Example 2a

A shaft and a golf club of comparative example 2a were obtained in the same manner as in the example 1a except that a sheet s1 (glass fiber reinforced prepreg) was substituted with a carbon fiber reinforced prepreg ("MR350C-175S" (trade name) manufactured by Mitsubishi Rayon Co., Ltd.).

Example 1b

Figure 4:
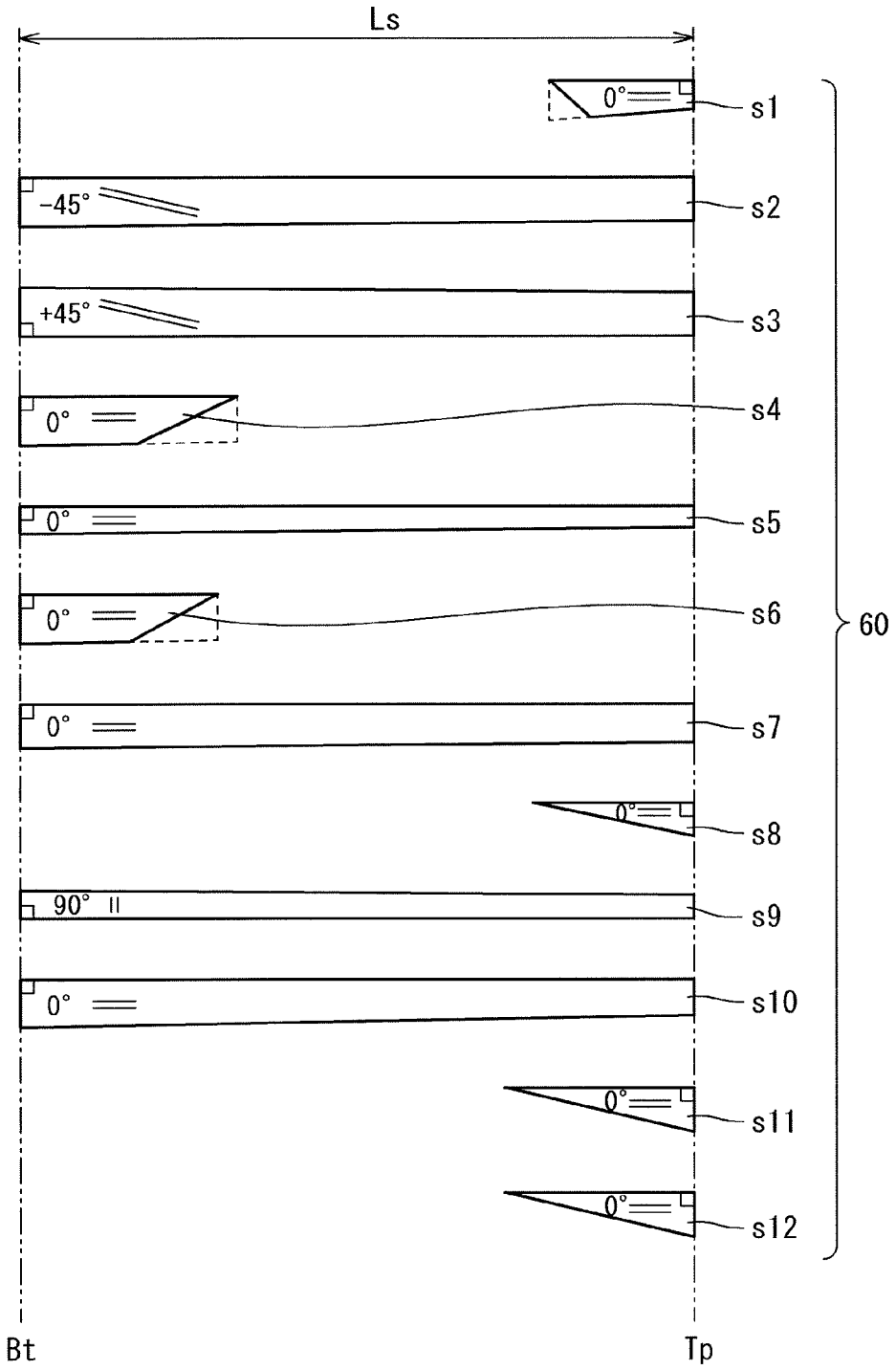
FIG. 4 is a developed view of a shaft according to a second embodiment.

A shaft 60 of example 1b was obtained in the same manner as in the example 1a except that a laminated constitution shown in FIG. 4 was used. In FIG. 4, trade names of prepregs used for sheets were as follows.

- sheet s1: GE352H-160S (manufactured by Mitsubishi Rayon Co., Ltd.)
- sheet s2: HRX350C-075S (manufactured by Mitsubishi Rayon Co., Ltd.)
- sheet s3: HRX350C-075S (manufactured by Mitsubishi Rayon Co., Ltd.)
- sheet s4: E1026A-14N (manufactured by Nippon Graphite Fiber Corporation)
- sheet s5: 2255S-10 (manufactured by Toray Industries, Inc.)
- sheet s6: 3255S-15 (manufactured by Toray Industries, Inc.)
- sheet s7: 3255S-10 (manufactured by Toray Industries, Inc.)
- sheet s8: 3255S-10 (manufactured by Toray Industries, Inc.)
- sheet s9: 805S-3 (manufactured by Toray Industries, Inc.)

sheet s10: 3255S-12 (manufactured by Toray Industries, Inc.)
sheet s11: 3255S-12 (manufactured by Toray Industries, Inc.)
sheet s12: 3255S-12 (manufactured by Toray Industries, Inc.)

The full length Ls of the shaft 60 of the example 1b was 1092 mm. A head (fairway wood) having a head volume of 170 cc and a grip were attached to the shaft 60 to obtain a golf club of the example 1b.

Examples 2b and 3b and Comparative Example 1b

Examples 2b and 3b and comparative example 1b having specifications shown in Table 3 to be described later were obtained by appropriately using the adjusting means. Shafts and golf clubs of the examples 2b and 3b and the comparative example 1b were obtained in the same manner as in the example 1b except for above.

Comparative Example 2b

A shaft and a golf club of comparative example 2b were obtained in the same manner as in the example 1b except that a sheet s1 (glass fiber reinforced prepreg) was substituted with a carbon fiber reinforced prepreg ("MR350C-175S" (trade name) manufactured by Mitsubishi Rayon Co., Ltd.).

Example 1c

Figure 5:
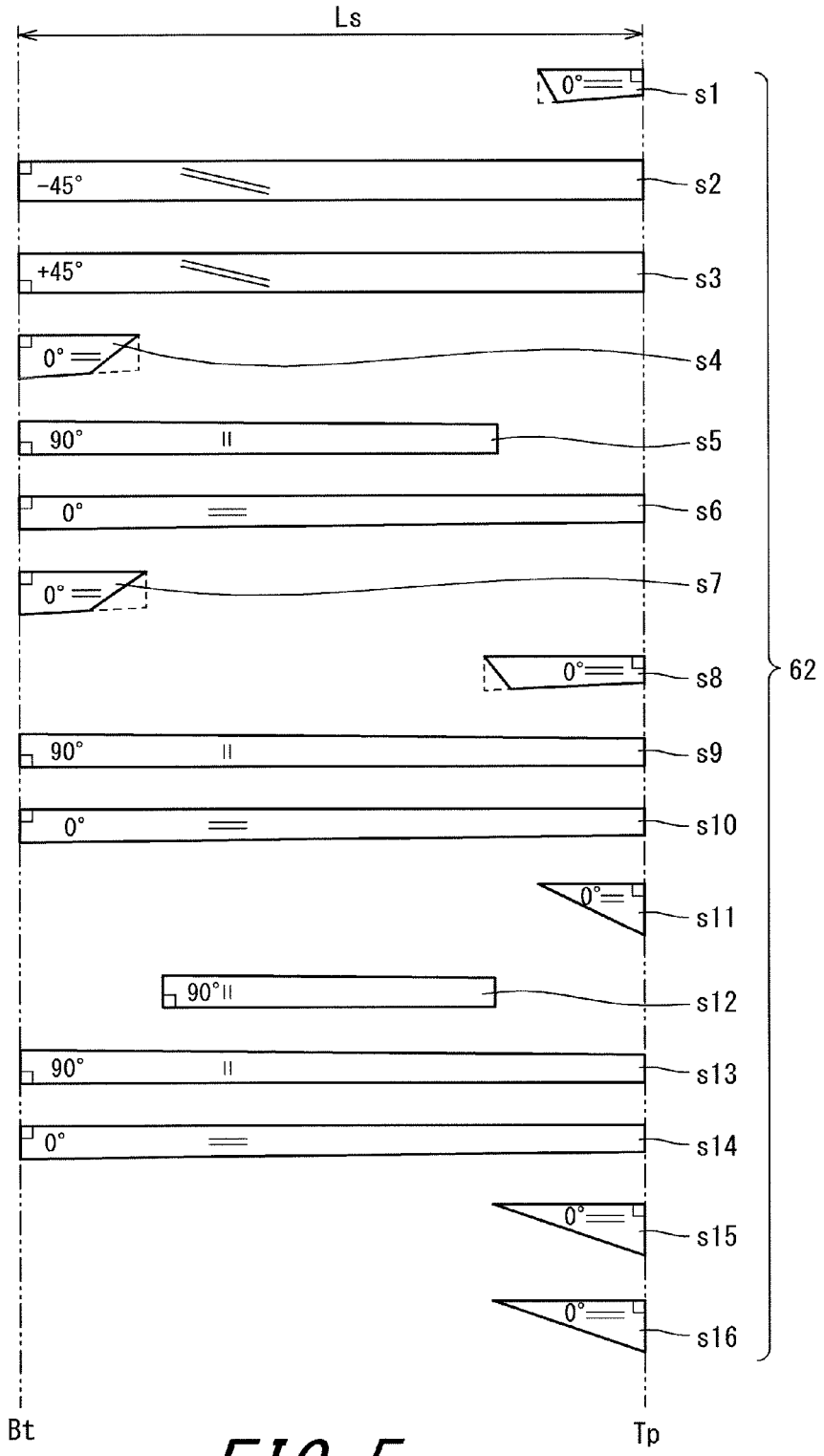
FIG. 5 is a developed view of a shaft according to a third embodiment.

A shaft 62 of example 1c was obtained in the same manner as in the example 1a except that a laminated constitution shown in FIG. 5 was used. In FIG. 5, trade names of prepregs used for sheets were as follows.

sheet s1: GE352H-160S (manufactured by Mitsubishi Rayon Co., Ltd.)
sheet s2: HRX350C-075S (manufactured by Mitsubishi Rayon Co., Ltd.)
sheet s3: HRX350C-075S (manufactured by Mitsubishi Rayon Co., Ltd.)
sheet s4: TR350C-075S (manufactured by Mitsubishi Rayon Co., Ltd.)
sheet s5: 805S-3 (manufactured by Toray Industries, Inc.)
sheet s6: TR350U-100S (manufactured by Mitsubishi Rayon Co., Ltd.)
sheet s7: TR350C-100S (manufactured by Mitsubishi Rayon Co., Ltd.)
sheet s8: 2276S-10 (manufactured by Toray Industries, Inc.)
sheet s9: 805S-3 (manufactured by Toray Industries, Inc.)
sheet s10: TR350U-100S (manufactured by Mitsubishi Rayon Co., Ltd.)
sheet s11: TR350C-125S (manufactured by Mitsubishi Rayon Co., Ltd.)
sheet s12: 805S-3 (manufactured by Toray Industries, Inc.)
sheet s13: 805S-3 (manufactured by Toray Industries, Inc.)
sheet s14: TR350C-125S (manufactured by Mitsubishi Rayon Co., Ltd.)
sheet s15: TR350C-100S (manufactured by Mitsubishi Rayon Co., Ltd.)
sheet s16: TR350C-100S (manufactured by Mitsubishi Rayon Co., Ltd.)

The full length Ls of the shaft 62 of the example 1c was 1168 mm. A titanium head (driver head) having a head volume of 460 cc and a grip were attached to the shaft 62 to obtain a golf club of the example 1c.

Examples 2c and 3c and Comparative Example 1c

Examples 2c and 3c and comparative example 1c having specifications shown in Table 4 to be described later were obtained by appropriately using the adjusting means. For example 3c, a sheet s12 was substituted with a full length hoop layer, and increase in a weight due to the substitution was compensated by reducing the resin content rate of the other prepreg. Shafts and golf clubs of the examples 2c and 3c and the comparative examples 1c were obtained in the same manner as in the example 1c except for above.

Comparative Example 2c

A shaft and a golf club of comparative example 2c were obtained in the same manner as in the example 1c except that a sheet s1 (glass fiber reinforced prepreg) was substituted with a carbon fiber reinforced prepreg ("MR350C-175S" (trade name) manufactured by Mitsubishi Rayon Co., Ltd.).

The following items were evaluated using the examples and the comparative examples.

[Test A: Driver/Hard Hitter]

Actual hitting tests were conducted by ten testers having a head speed of 42 m/s or greater and 50 m/s or less in a driver. In the test A, the examples 1a to 3a and the comparative examples 1a and 2a were used. In all the shafts used in the test A, a flex and a torque were made the same. These specifications and evaluation results are shown in the following Table 2.

[Test B: Fairway Wood/Hard Hitter]

Actual hitting tests were conducted by the same ten testers as those in the test A. In the test B, the examples 1b to 3b and the comparative examples 1b and 2b were used. In all the shafts used in the test B, a flex and a torque were made the same. These specifications and evaluation results are shown in the following Table 3.

[Test C: Driver/Average Golfer]

Actual hitting tests were conducted by ten testers having a head speed of 37 m/s or greater and 42 m/s or less in a driver. In the test C, the examples 1c to 3c and the comparative examples 1c and 2c were used. In all the shafts used in the test C, a flex and a torque were made the same. These specifications and evaluation results are shown in the following Table 4.

[Evaluation Methods]

[Easiness of Swing]

Sensuous evaluation of easiness of swing was made on a scale of one to five. A shaft thought to be easily swung provided a higher score. The average scores of the ten testers (the figures below the decimal point are rounded off) are shown in the following Tables 2 to 4.

[Feeling: Firm Feeling]

Sensuous evaluation of a firm feeling was made on a scale of one to five. A shaft having a better firm feeling provided a higher score. The average scores of the ten testers (the figures below the decimal point are rounded off) are shown in Tables 2 and 3. A hard hitter shows a marked tendency to attach importance to the firm feeling. For this reason, the firm feeling was evaluated in the tests A and B.

[Feeling: Bending Feeling]

Sensuous evaluation of a bending feeling was made on a scale of one to five. A shaft having a better bending feeling provided a higher score. The average scores of the ten testers (the figures below the decimal point are rounded off) are shown in Table 4. An average golfer shows a marked tendency to attach importance to the bending feeling. For this reason, the bending feeling was evaluated in the test C.

[Lateral Deviation Amount (Variation)]

In order to evaluate the stability of the behavior of the shaft, the variation in a hit ball was evaluated. Each of the testers hit five golf balls toward the target with each of the clubs. Among the five hit ball results, a distance between the position of a ball reaching the rightmost side and the position of a ball reaching the leftmost side was measured. The distance was measured along a direction perpendicular to a straight line connecting a hit ball point and a target point. The distance was measured in each of the ten testers. The average values of the ten testers' data are shown as a "lateral deviation amount" in the following Tables 2 to 4.

[Method for Measuring Impact-Absorbing Energy]

Figure 6:
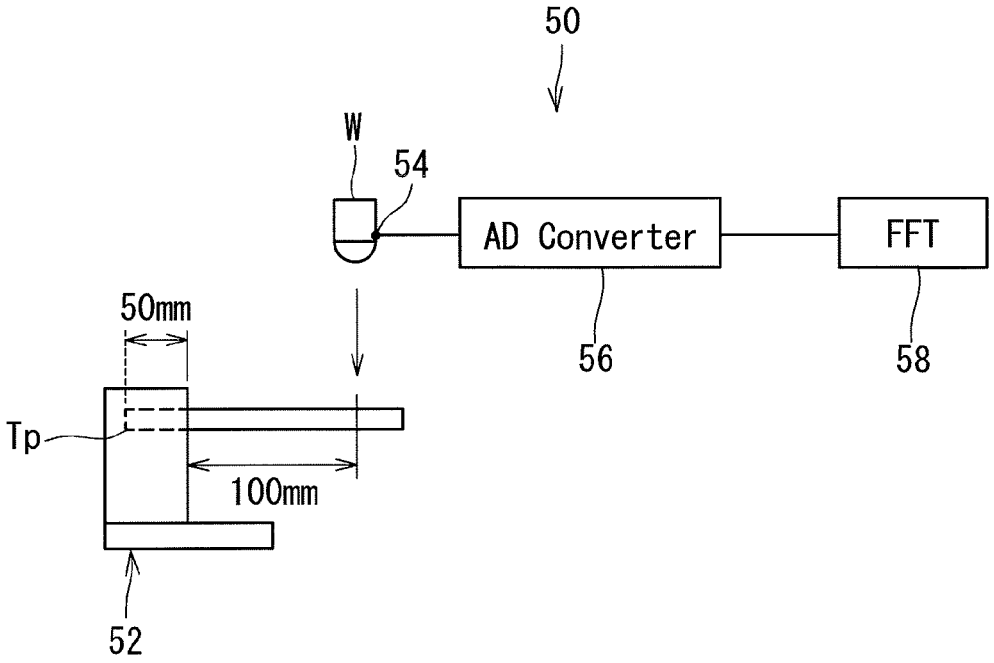
FIG. 6 is a schematic view showing a method for measuring an impact-absorbing energy.

FIG. 6 shows a method for measuring an impact-absorbing energy. An impact test was conducted by a cantilever bending method. A drop weight impact tester (IITM-18) manufactured by Yonekura MFG Co., Ltd. was used as a measuring apparatus 50. A tip part between a tip end Tp of the shaft and a position separated by 50 mm from the tip end Tp was fixed to a fixing jig 52. A weight W of 600 g was dropped to the shaft at a position separated by 100 mm from the fixed end and the weight W was dropped from the upper side at 1500 mm above the position. An accelerometer 54 was attached to the weight W. The accelerometer 54 was connected to an FFT analyzer 58 through an AD converter 56. A measurement wave profile was obtained by FFT treatment. Displacement D and an impact flexural load L were measured by the measurement to calculate an impact-absorbing energy before breakage started.

Figure 7:
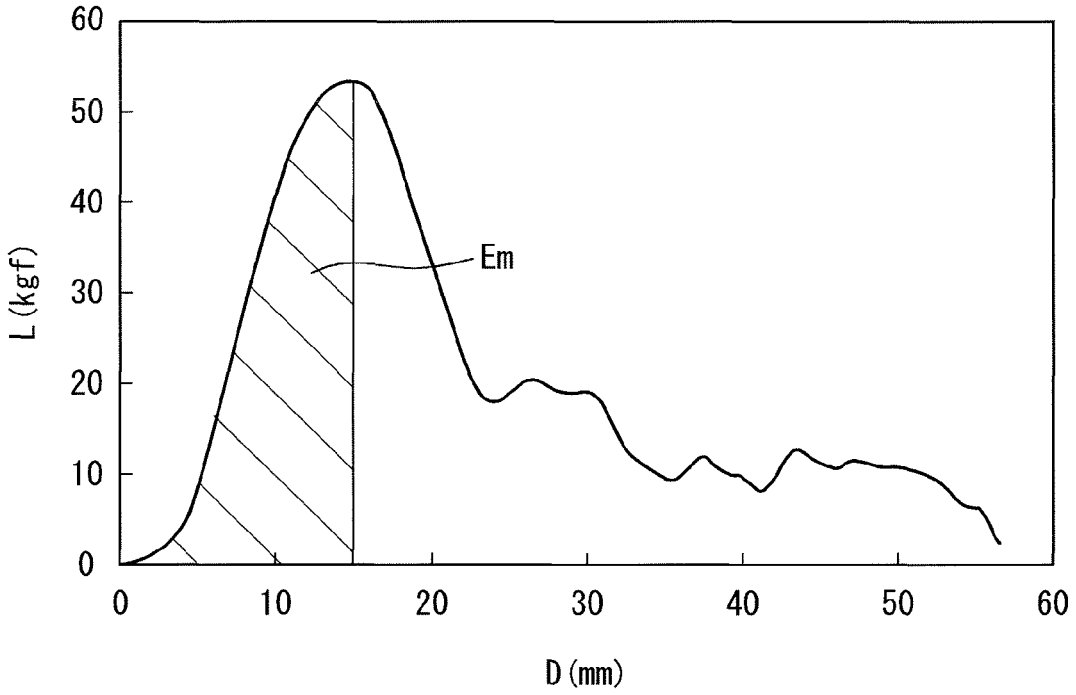
FIG. 7 is a graph showing an example of a wave profile obtained when the impact-absorbing energy is measured.

FIG. 7 is an example of the measured wave profile. The wave profile is a graph showing the relationship between the displacement D (mm) and the impact flexural load L (kgf). In the graph of FIG. 7, the area of a portion represented by hatching represents an impact-absorbing energy Em (J).

These evaluation results are shown in the following Tables 2 to 4. The following Table 1 is an example of prepregs capable of being used in the present invention.

TABLE 1

Examples of prepregs capable of being used

| Manufacturer | Trade name | Thickness of sheet (mm) | Fiber content rate (% by mass) | Resin content rate (% by mass) | Physical property value of reinforced fiber: Part number of fiber | Tensile elastic modulus ($t/mm^2$) | Tensile strength ($kgf/mm^2$) |
|---|---|---|---|---|---|---|---|
| TORAY Industries, Inc. | 3255S-10 | 0.082 | 76 | 24 | T700S | 23.5 | 500 |
| TORAY Industries, Inc. | 3255S-12 | 0.103 | 76 | 24 | T700S | 23.5 | 500 |
| TORAY Industries, Inc. | 3255S-15 | 0.123 | 76 | 24 | T700S | 23.5 | 500 |
| TORAY Industries, Inc. | 805S-3 | 0.034 | 60 | 40 | M30S | 30 | 560 |
| TORAY Industries, Inc. | 2255S-10 | 0.082 | 76 | 24 | T800S | 30 | 600 |
| TORAY Industries, Inc. | 2255S-12 | 0.102 | 76 | 24 | T800S | 30 | 600 |
| TORAY Industries, Inc. | 2255S-15 | 0.123 | 76 | 24 | T800S | 30 | 600 |
| TORAY Industries, Inc. | 2256S-10 | 0.077 | 80 | 20 | T800S | 30 | 600 |
| TORAY Industries, Inc. | 2256S-12 | 0.103 | 80 | 20 | T800S | 30 | 600 |
| TORAY Industries, Inc. | 2276S-10 | 0.077 | 80 | 20 | T800S | 30 | 600 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |
| Mitsubishi Rayon Co., Ltd. | GE352H-160S | 0.150 | 65 | 35 | E Glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured based on JIS R7601:1986 "Test Method for Carbon Fibers".

TABLE 2

Specifications and evaluation results of examples and comparative examples (Test A: Driver/Hard Hitter)

| | Unit | Example 1a | Example 2a | Example 3a | Comparative example 1a | Comparative example 2a |
|---|---|---|---|---|---|---|
| Laminated constitution | — | FIG. 3 | FIG. 3 | FIG. 3 (sheet s6 is changed) | Closely related to FIG. 3 | FIG. 3 |
| Full length Ls of shaft | mm | 1168 | 1168 | 1168 | 1168 | 1168 |
| Weight Ws of shaft | g | 62 | 62 | 62 | 62 | 62 |
| Lg/Ls | — | 0.56 | 0.54 | 0.55 | 0.51 | 0.56 |
| Rf2 > Rf1 and Rf2 > Rf3 | — | ○ | ○ | X | ○ | ○ |
| (Ws1 + Ws3)/Ws2 | — | 2.4 | 2.0 | 2.5 | 2.0 | 2.4 |
| Ws3/Ws2 | — | 1.23 | 1.25 | 1.24 | 1.05 | 1.23 |
| Easiness of swing | Score | 5 | 2 | 2 | 1 | 3 |
| Feeling Firm feeling | Score | 5 | 4 | 1 | 3 | 3 |
| Impact-absorbing energy | J | 4.0 | 4.0 | 3.9 | 3.9 | 3.0 |
| Lateral deviation amount (variation) | yard | 3 | 20 | 5 | 18 | 4 |

TABLE 3

Specifications and evaluation results of examples and comparative examples (Test B: FW/Hard Hitter)

| | Unit | Example 1b | Example 2b | Example 3b | Comparative example 1b | Comparative example 2b |
|---|---|---|---|---|---|---|
| Laminated constitution | — | FIG. 4 | FIG. 4 | FIG. 4 | Closely related to FIG. 4 | FIG. 4 |
| Full length Ls of shaft | mm | 1092 | 1092 | 1092 | 1092 | 1092 |
| Weight Ws of shaft | g | 62 | 62 | 62 | 62 | 62 |
| Lg/Ls | — | 0.56 | 0.53 | 0.54 | 0.51 | 0.56 |
| Rf2 > Rf1 and Rf2 > Rf3 | — | X | X | X | X | X |
| (Ws1 + Ws3)/Ws2 | — | 2.5 | 2.0 | 2.4 | 2.0 | 2.5 |
| Ws3/Ws2 | — | 1.52 | 1.46 | 1.48 | 1.13 | 1.52 |
| Easiness of swing | Score | 4 | 3 | 3 | 1 | 4 |
| Feeling Firm feeling | Score | 2 | 2 | 2 | 2 | 2 |
| Impact-absorbing energy | J | 4.2 | 4.1 | 4.2 | 4.0 | 2.9 |
| Lateral deviation amount (variation) | yard | 3 | 15 | 3 | 16 | 4 |

TABLE 4

Specifications and evaluation results of examples and comparative examples (Test C: Driver/Average Golfer)

| | Unit | Example 1c | Example 2c | Example 3c | Comparative example 1c | Comparative example 2c |
|---|---|---|---|---|---|---|
| Laminated constitution | — | FIG. 5 | FIG. 5 | FIG. 5 (sheet s12 is changed) | Closely related to FIG. 5 | FIG. 5 |
| Full length Ls of shaft | mm | 1168 | 1168 | 1168 | 1168 | 1168 |

TABLE 4-continued

Specifications and evaluation results of examples and comparative examples (Test C: Driver/Average Golfer)

| | Unit | Example 1c | Example 2c | Example 3c | Comparative example 1c | Comparative example 2c |
|---|---|---|---|---|---|---|
| Weight Ws of shaft | g | 42 | 42 | 42 | 42 | 42 |
| Lg/Ls | — | 0.53 | 0.53 | 0.53 | 0.51 | 0.53 |
| Rf2 > Rf1 and Rf2 > Rf3 | — | ○ | ○ | X | ○ | ○ |
| (Ws1 + Ws3)/Ws2 | — | 2.6 | 2.0 | 2.5 | 2.0 | 2.5 |
| Ws3/Ws2 | — | 1.24 | 1.25 | 1.23 | 1.12 | 1.24 |
| Easiness of swing | Score | 4 | 3 | 3 | 1 | 3 |
| Feeling Firm feeling | Score | 4 | 1 | 1 | 3 | 3 |
| Impact-absorbing energy | J | 3.8 | 3.9 | 3.8 | 3.7 | 2.7 |
| Lateral deviation amount (variation) | yard | 1 | 12 | 2 | 10 | 2 |

As shown in these results, as Lg/Ls is larger, the easiness of swing tends to be improved.

In Tables 2 to 4, when "Rf2 is greater than Rf1 and Rf3" is met, "o" is described. When "Rf2 is greater than Rf1 and Rf3" is not met, "x" is described. When Rf2 is greater than Rf1 and Rf3, the feeling tends to be improved.

As shown in Tables 2 to 4, as (Ws1+Ws3)/Ws2 is larger, the lateral deviation amount (variation) tends to be reduced. In Table 4, as (Ws1+Ws3)/Ws2 is larger, the bending feeling tends to be better.

As shown in Tables 2 to 4, the impact-absorbing energy is increased by the existence of the glass fiber reinforced layer.

Thus, the examples are highly evaluated as compared with the comparative examples. The advantages of the present invention are apparent.

The method described above can be applied to the golf club shaft.

The description hereinabove is merely for an illustrative example, and various modifications can be made in the scope not to depart from the principles of the present invention.

What is claimed is:

1. A golf club shaft comprising:

full length layers disposed wholly in a longitudinal direction of the shaft;

a tip end partial layer disposed on a tip part of the shaft; and a hoop layer that includes a middle partial hoop layer;

wherein the full length layers include a bias layer and a straight layer;

the tip end partial layer includes an inner glass fiber reinforced layer;

when a full length of the shaft is defined as Ls and a distance between a tip end of the shaft and a center of gravity G of the shaft is defined as Lg, a ratio (Lg/Ls) is 0.52 or greater and 0.65 or less and the full length Ls of the shaft is equal to or greater than 44 inches;

a weight of the shaft is equal to or less than 65 g;

wherein the shaft is equally divided into three in the longitudinal direction to section the shaft into a tip region, a middle region, and a butt region;

if a weight of the hoop layer in the tip region is defined as Rf1, a weight of the hoop layer in the middle region is defined as Rf2, and a weight of the hoop layer in the butt region is defined as Rf3, the weight Rf2 is greater than the weight Rf1, and the weight Rf2 is greater than the weight Rf3;

if a length of the middle partial hoop layer in the longitudinal direction is defined as Lz, Lz/Ls is equal to or greater than 0.45; and wherein the bias layer and the straight layer as the full length layers are formed of carbon fiber reinforcing prepregs.

2. The golf club shaft according to claim 1, wherein the inner glass fiber reinforced layer is positioned inside the bias layer.

3. The golf club shaft according to claim 1, wherein the inner glass fiber reinforced layer is an innermost layer.

4. The golf club shaft according to claim 1, wherein, when a weight of the shaft in the tip region is defined as Ws1, a weight of the shaft in the middle region is defined as Ws2, and a weight of the shaft in the butt region is defined as Ws3, (Ws1+Ws3)/Ws2 is equal to or greater than 2.1.

5. The golf club shaft according to claim 1, wherein, when a weight of the shaft in the middle region is defined as Ws2 and a weight of the shaft in the butt region is defined as Ws3, Ws3/Ws2 is 1.1 or greater and 2 or less.

* * * * *